United States Patent [19]

Geiser

[11] Patent Number: 4,615,249

[45] Date of Patent: Oct. 7, 1986

[54] APPARATUS FOR TRIMMING STACKS OF PAPER SHEETS OR THE LIKE

[75] Inventor: Peter Geiser, Winterthur, Switzerland

[73] Assignee: Grapha-Holding AG, Hergiswil, Switzerland

[21] Appl. No.: 778,154

[22] Filed: Sep. 16, 1985

Related U.S. Application Data

[63] Continuation of Ser. No. 489,231, Apr. 27, 1983, abandoned.

[30] Foreign Application Priority Data

May 6, 1982 [CH] Switzerland ..... 2787/82

[51] Int. Cl.[4] ..... B26D 7/22; B26D 5/14

[52] U.S. Cl. ..... 83/221; 83/240; 83/305; 83/557; 83/925 A

[58] Field of Search ..... 83/215, 221, 240, 519, 83/618, 925 A, 305, 557

[56] References Cited

U.S. PATENT DOCUMENTS 4,134,334 1/1979 Johnson ..... 83/240 X 4,202,232 5/1980 Müller ..... 83/519

*Primary Examiner*—Donald R. Schran

*Attorney, Agent, or Firm*—Peter K. Kontler

[57] ABSTRACT

A machine for trimming the edges of stacked paper sheets at a trimming station has a conveyor which delivers successive stacks to the trimming station, several knives which are movable from raised positions to lower end positions to thereby trim the respective edges of a stack at the trimming station, anvil blocks which are penetrated into by the cutting edges of the knives when the knives complete their working strokes subsequent to trimming of a stack, and a control unit which prevents the knives from contacting the respective blocks if the knives perform working strokes in the absence of a stack at the trimming station. The control unit can shift the working strokes of the knives and/or lower the blocks to thus ensure that the cutting edges of the knives are arrested short of the respective blocks when a photocell detects the absence of a stack at the trimming station while the knives perform their working strokes.

10 Claims, 4 Drawing Figures

APPARATUS FOR TRIMMING STACKS OF PAPER SHEETS OR THE LIKE

This application is a continuation of application Ser. No. 489,231 filed Apr. 27, 1983, and now abandoned.

BACKGROUND OF THE INVENTION

The present invention relates to improvements in apparatus for trimming the edges of stacked paper sheets or analogous commodities. More particularly, the invention relates to improvements in trimming apparatus for brochures, pamphlets, magazines, signatures, books or the like.

Commonly owned U.S. Pat. No. 4,202,232 (the disclosure of this patent is incorporated herein by reference) describes a trimming apparatus wherein several knives are movable between raised and lowered positions to trim three sides of a stack of sheets (e.g., a brochure) which is delivered to a trimming station. The arrangement is such that the operation of the conveyor which delivers successive stacks to the trimming station is synchronized with the working strokes of the knives so that the knives descend after the stack is properly positioned at the trimming station. Each knife descends toward and penetrates into the material of an anvil block which is provided therefor at the trimming station. Since the path of a knife during and after trimming of the stack at the trimming station is not identical with the path along which the knife advances in the absence of a commodity at the trimming station, the cutting edge of each knife enters a first portion of the respective block upon completion of a trimming operation and a different second portion of such block when the knife performs a working stroke without carrying out a trimming operation. This will be readily appreciated since the material of the stack offers a pronounced resistance to penetration of the cutting edge and invariably alters the path of the cutting edge by exerting upon the knife a lateral pressure which is the cause of penetration of the cutting edge into a portion of the block other than the portion which is penetrated into if the knife descends while the trimming station is unoccupied. The just discussed mode of operation entails the making of several grooves in the material of each anvil block with attendant pronounced shortening of the useful life of the blocks.

Heretofore known proposals to prevent unnecessary penetration of the cutting edges of trimming knives into the associated blocks in the absence of stacks of paper sheets or the like at the trimming station include the provision of means for arresting the knives if the trimming station is unoccupied due to the failure of the conveyor to deliver a stack of sheets in good time before the knives begin their working strokes. However, frequent stoppages and repeated starting of the trimming apparatus entail pronounced wear on the parts of such apparatus and cause a pronounced reduction of the output. In other words, it is desirable to keep the knives and other mobile parts of the trimming apparatus in motion even at a time when the trimming station fails to receive successive commodities at anticipated intervals.

OBJECTS AND SUMMARY OF THE INVENTION

An object of the invention is to provide a trimming apparatus for brochures, pamphlets or the like which is constructed and assembled in such a way that the wear upon its parts, as a result of intermittent failure of the conveyor system to deliver stacks of paper sheets at anticipated intervals, is but a fraction of the wear upon the parts of conventional apparatus.

Another object of the invention is to provide a trimming apparatus wherein the useful life of the anvil blocks, which are penetrated into by the cutting edges of the knives when the knives complete their working strokes, is much longer than in heretofore known apparatus.

A further object of the invention is to provide the above outlined apparatus with novel and improved means for regulating the working stroke(s) of its trimming knife or knives.

Still another object of the invention is to provide the trimming apparatus with novel and improved means for controlling the positions of anvil blocks with reference to the associated trimming knives.

An additional object of the invention is to provide a trimming apparatus wherein the operation of the drive means for the knife or knives need not be interrupted when the trimming station fails to receive stacks of paper sheets or the like at anticipated or prescribed intervals.

Another object of the invention is to provide a novel and improved method of prolonging the useful life of selected parts in an apparatus for trimming brochures, books, pamphlets or the like.

Another object of the invention is to provide a trimming apparatus whose operation need not be monitored by attendants for the express purpose of preventing the knife or knives from performing working strokes in the absence of commodities at the trimming station.

The invention is embodied in an apparatus for trimming the edges of stacks of paper sheets or analogous commodities at a trimming station. The apparatus comprises conveyor means (e.g., an endless belt or chain conveyor) for delivering successive commodities to the trimming station, at least one knife which performs recurrent working strokes by moving from a first (preferably raised) to a spaced-apart second (preferably lowered) position to thereby trim an edge of the commodity at the trimming station, drive means for moving the knife in the aforedescribed manner, an anvil block which is located in the path of movement of and is normally engaged by the knife when the latter completes a working stroke upon completed trimming of a commodity at the trimming station, and control means which is actuatable to prevent engagement between the knife and the block when the knife completes a working stroke in the absence of a commodity at the trimming station.

The control means can comprise means for shifting the positions of the knife so that the latter cannot reach and cannot penetrate into the material of the anvil block. Alternatively, or in addition to such changes in the positions of the knife, the control means can comprise means for shifting the block with reference to the knife, again for the purpose of preventing penetration of the cutting edge of the knife into the material of the block when the knife completes its working stroke.

The apparatus preferably further comprises means (e.g., a photocell having a signal generating means in the form of a photoelectronic transducer or the like) for monitoring the trimming station and for generating signals which actuate the control means in response to detected absence of a commodity at the trimming station while the knife performs a working stroke. The control means can comprise at least one fluid-operated (e.g., hydraulic) motor which serves to maintain the knife and the block out of contact with one another in response to a signal from the monitoring means.

The apparatus can comprise at least one additional trimming knife which serves to trim another edge of the commodity at the trimming station, an additional anvil block for the additional knife, and additional drive means for causing the additional knife to perform working strokes. The control means is then arranged to prevent the additional knife from engaging the additional block in response to a signal from the monitoring means. The material of at least a portion of each anvil block is preferably sufficiently soft to allow the cutting edge of the respective knife to penetrate into the material of the block when the knife completes a working stroke in the presence of a commodity at the trimming station.

The drive means for each knife can comprise a variable-length motion transmitting device which is connected with the respective knife, and the control means then comprises means for changing the length of the motion transmitting device in response to a signal from the monitoring means. In addition to changing the length of the just discussed motion transmitting device or devices, or in lieu of such mode of operation, the control means can also include means for shifting (in response to a signal from the monitoring means) the anvil block or blocks from a position nearer to a position more distant from the respective knife in the second position of the respective knife.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
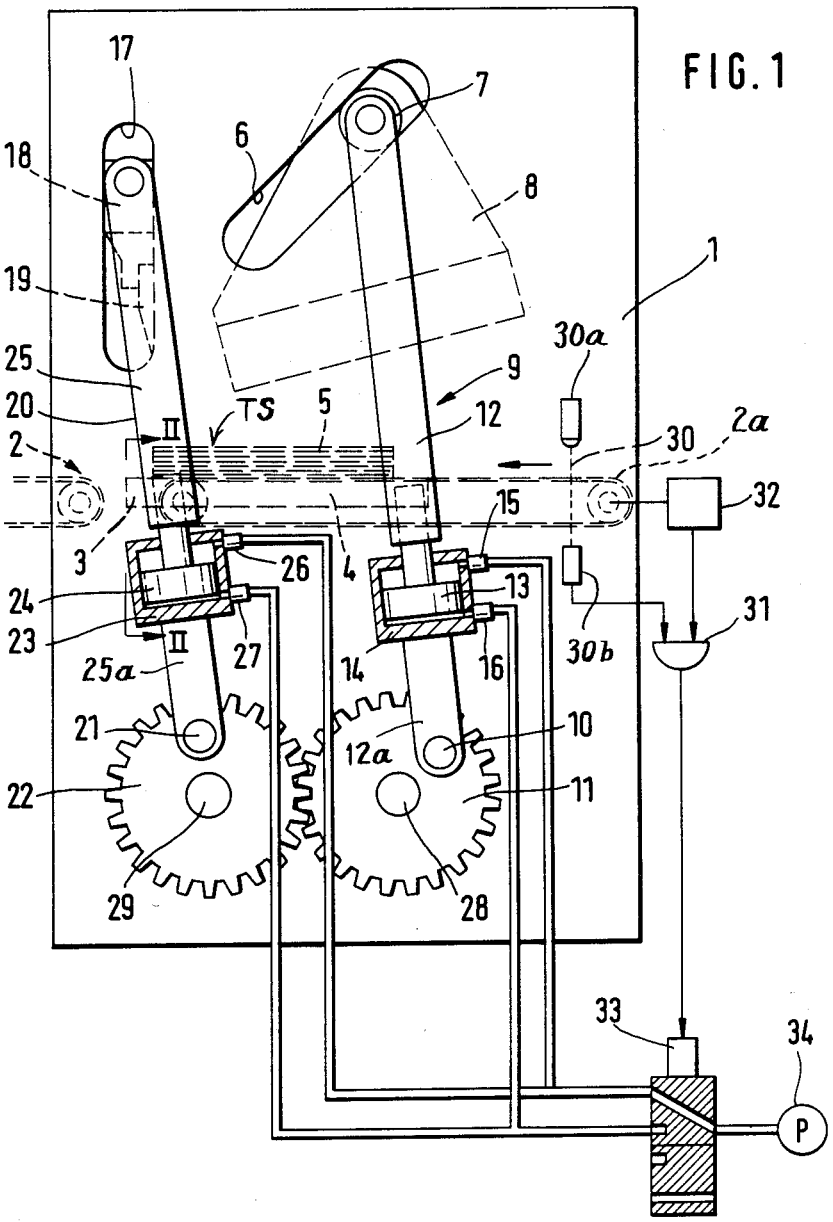
FIG. 1 is a schematic partly elevational and partly central vertical sectional view of a trimming apparatus which embodies one form of the invention and wherein the control unit is designed to regulate the working strokes of the knives.

Referring first to FIG. 1, there is shown a trimming apparatus which comprises two spaced-apart parallel upright sidewalls or cheeks 1 (only one shown) forming part of a frame which supports an endless belt or chain conveyor 2 serving as a means for intermittently delivering successive stacks 5 of paper sheets to a trimming station TS in the space between the two sidewalls 1. The sidewalls 1 are connected to one another by rigid crossbeams (not specifically shown). The upper reach of the belt conveyor 2 supports the stack 5 in the course of the trimming operation, and such upper reach is coplanar with the upper sides of two parallel anvil blocks 4 which are inwardly adjacent to the sidewalls 1 and with the upper side of a third anvil block 3 which extends transversely between the two sidewalls. The conveyor 2 is driven by a suitable timing shaft (not shown) so that it supplies successive stacks 5 at selected (preferably regular) intervals and that it advances freshly trimmed stacks beyond the trimming station TS, e.g., into the range of a transfer device (not shown) which lifts successive trimmed stacks off the upper reach of the conveyor 2 and deposits them on a further conveyor, not shown, or onto a takeoff conveyor. Reference may be had to the commonly owned U.S. patent application Ser. No. 245,986 filed Mar. 20, 1981 by Hans Müller for "One-station block trimming machine", now abandoned.

The trimming apparatus of FIG. 1 further comprises two trimming knives 8 (disposed one behind the other so that only one thereof can be seen in FIG. 1) which serve to trim the respective (head and foot) edges of a stack 5 at the trimming station TS and cooperate with the respective blocks 4, and a third trimming knife 19 which serves to trim a third (front) edge of the stack 5 at the station TS and cooperates with the transverse anvil block 3. The arrangement is such that the position of the stack 5 at the station TS is not changed between the instant of introduction by the upper reach of the conveyor 2 and the instant of removal of the finished (fully trimmed) stack into the range of a take-off conveyor.

The knives 8 are suspended on a shaft 7 which moves sideways in suitably inclined guide slots 6 of the sidewalls 1 when the knives 8 are caused to perform their working and return strokes. The drive means for the knives 8 comprises one or two elongated motion transmitting members in the form of push rods 9 whose upper portions 12 are connected to the shaft 7 at the outer sides of the respective sidewalls 1 and whose lower portions **12*a* are coupled to the eccentric pins 10 of discrete disc-shaped eccentrics 11 mounted on a horizontal shaft 28 which is journalled in the sidewalls 1 at a level below the trimming station TS and is parallel to the shaft 7. When the eccentrics 11 are caused to rotate, the respective pins 10 orbit along endless paths and cause the knives 8 to perform working strokes alternating with return strokes. During its working stroke, each knife 8 turns in its plane so that the cut begins at one end and terminates at the other end of the respective edge of the stack 5** at the trimming station TS.

In accordance with a feature of the invention, the trimming apparatus comprises control means which includes means for varying the length of the motion transmitting members 9 and hence the positions of the knives upon completion of their working strokes. Such length-varying means comprises double-acting hydraulic cylinders 14 which are connected to the lower portions **12*a* of the respective motion transmitting members 9 and pistons 13 which are reciprocable in the respective cylinders 14 and are preferably adjustably attached to the lower ends of the upper portions 12 of the respective motion transmitting members 9. Each cylinder 14 is connected with two conduits 15, 16** which can admit a pressurized hydraulic fluid into or can permit escape of hydraulic fluid from the respective cylinder chambers.

The cylinder chambers can receive pressurized fluid from a pump 34 or another suitable source by way of a solenoid-operated valve 33. The valve 33 discharges fluid from one cylinder chamber into the sump when the other cylinder chamber is ready to receive or is in the process of receiving pressurized fluid from the source 34, and vice versa.

The sidewalls 1 are further formed with aligned vertical or nearly vertical guide slots 17 for a polygonal crosshead or rod 18 which is reciprocable in the slots 17 and supports the trimming knife 19. The drive means for the knife 19 comprises at least one elongated motion transmitting member 20 having an upper portion 25 which is attached to the respective end of the rod 18 and a lower portion 25*a* which is attached to an eccentric pin 21 of a disc-shaped eccentric 22. The latter is mounted on a horizontal shaft 29 which is journalled in the sidewalls 1 and is parallel to the shaft 28 for the eccentric 11. In the illustrated embodiment, the eccentrics 11 and 22 have annuli of mating teeth to ensure accurate synchronization of movements of the knives 8 with the movements of the knife 19.

The aforementioned control means further comprises means for varying the length of the motion transmitting member 20, and such length varying means comprises a double-acting hydraulic cylinder 23 at the upper end of the lower portion 25*a*, a piston 24 which is adjustably secured to the lower end of the upper portion 25 and is reciprocably installed in the cylinder 23, and two conduits 26, 27 which are connectable with or sealable from the source 34 of pressurized hydraulic fluid, e.g., oil, by the solenoid-operated valve 33. The shafts 28, 29 are driven by the aforementioned timing shaft for the conveyor 2 so that the delivery of successive stacks 5 to the trimming station TS is properly synchronized with the working and return strokes of the knives 8, 8 and 19.

The angular positions of the eccentric pins 10 and 21 with reference to the corresponding shafts 28, 29 are selected in such a way that the knife 19 performs its working stroke ahead of the knives 8, i.e., the front edge of a stack 5 at the trimming station TS is treated ahead of the head and foot edges. When the solenoid of the valve 33 is deenergized, the conduits 16 and 27 receive pressurized fluid from the source 34 and the conduits 15, 26 are connected to the sump. In other words, at such time, the length of each of the motion transmitting members 9, 20 is increased to a maximum value It is assumed that the conveyor 2 has completed the delivery of a fresh stack 5 to the trimming station TS and has come to a halt in a position corresponding to the optimum position of the stack with reference to the paths of movement of the knives 8, 8, and 19. The presence of the freshly delivered stack 5 at the station TS is detected by a monitoring device 30 in the form of a photocell having a light source 30*a* at a level above and a photoelectronic transducer 30*b* at a level below the path of successive stacks 5. The transducer 30*b* transmits a signal to one input of a logic circuit here shown as an AND gate 31 the other input of which receives signals from a timer 32, e.g., a pulse generator which is operated by the shaft for the right-hand pulley 2*a* of the conveyor 2. In other words, the timer 32 transmits to the corresponding input of the AND gate 31 a pulse whenever a stack 5 is supposed to be located at the trimming station TS. The output of the AND gate 31 transmits a signal when its inputs simultaneously receive signals from the transducer 30*b* and timer 32, and such output signal is used to energize the solenoid of the valve 33 so that the latter connects the conduits 15 and 26 with the source 34 of pressurized fluid whereas the conduits 16 and 27 are free to communicate with the sump via valve 33. In other words, the appearance of a signal at the output of the AND gate 31 entails a shortening of the motion transmitting members 9 and 20. This causes the descending knife 19 to trim the front edge of the stack 5 at the trimming station TS and the cutting edge of this knife penetrates into the material of the associated anvil block 3 when the trimming of the front edge is completed. The descending knives 8 thereupon trim the head and foot edges of the partially treated stack 5 at the station TS and the cutting edges of the knives 8 ultimately penetrate into the material of the respective anvil blocks 4.

Figure 2:
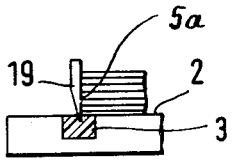
FIG. 2 illustrates a detail in the apparatus of FIG. 1, one of the knives being shown in engagement with the associated anvil block upon completion of its normal working stroke.

FIG. 2 shows that, when the motion transmitting member or members 20 are shortened as a result of admission of pressurized hydraulic fluid via conduit or conduits 26 (while the conduit or conduits 27 are free to communicate with the sump), the cutting edge of the trimming knife 19 penetrates into or at least contacts the upper side of the anvil block 3 at a level below the freshly trimmed front edge 5*a* of the stack 5 at the trimming station TS. Penetration of the cutting edge of the knife 19 into the block 3 after the knife 19 completes its working stroke is possible because the length of the motion transmitting member 20 is reduced by the cylinder and piston unit 23, 24, i.e., the throw of the eccentric 22 is the same as if the solenoid of the valve 33 were deenergized but the upper end position of the polygonal rod 18 (which carries the knife 19) is moved to a lower level in response to a reduction of the distance between the axis of the rod 18 and the axis of the eccentric pin 21.

The situation is analogous with the knives 8, i.e., the starting or upper end positions of these knives are moved to a lower level in response to admission of pressurized fluid into the upper chambers of the cylinders 14 via conduits 15 and simultaneous connection of the conduits 16 with the sump. In other words, the distance between the axis of the shaft 7 on the one hand and the common axis of the two eccentric pins 10 on the other hand is reduced in response to energization of the solenoid of the valve 33.

If the source 34 contains or supplies a compressed gas, the conduits which are not connected with such source are free to communicate with the atmosphere. At least a portion of each of the conduits 15, 16, 26, 27 is flexible or comprises sections which are slidably telescoped into one another to allow for shortening or lengthening of the respective motion transmitting members 9 and 20.

Figure 3:
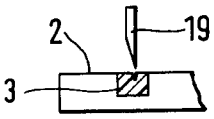
FIG. 3 illustrates the structure of FIG. 2 but with the knife out of contact with the associated anvil block in view of the absence of a paper stack at the trimming station.

If the conveyor 2 fails to deliver a stack 5 to the trimming station TS at a time when the timer 32 transmits a signal to the corresponding input of the AND gate 31, the other input of the gate 31 does not receive a signal from the transducer 30*b* of the monitoring means 30 so that the solenoid of the valve 33 remains deenergized. Therefore, the conduits 16, 27 remain connected with the source 34 and the length of each of the motion transmitting members 9, 20 is increased to the maximum value. Consequently, when the knife 19 performs a working (downward) stroke, its cutting edge fails to reach the associated anvil block 3 (see FIG. 3) so that the block 3 is not damaged (slotted, grooved, scored or similarly affected) when the knife 19 performs a working stroke in the absence of a stack 5 at the trimming station TS. The same applies for the knives 8, i.e., such knives fail to reach and penetrate into the material of the respective blocks 4 when the trimming station TS does not accommodate a stack 5 at the time when the element 32 transmits a signal to the corresponding input of the AND gate 31, namely, at the time when the station TS is supposed to accommodate a stack. The just described construction and mode of operation of the control means and of the monitoring means 30 ensures that the useful life of the blocks 3 and 4 is much longer than in heretofore known apparatus wherein the cutting edges of the knives continue to penetrate into the respective blocks whenever the knives perform their working strokes. Also, the output of the improved apparatus is higher than that of conventional apparatus wherein the detected absence of a stack triggers an immediate stoppage of the apparatus or, at the very least, a stoppage of means for driving the trimming knife or knives. Moreover, the wear upon the moving parts is much less pronounced if the apparatus is not arrested in response to the absence of a stack at the trimming station at a time when the stack should be there to undergo one or more trimming operations.

As mentioned above, the cutting edges of the trimming knives travel along first paths if the knives are brought into engagement with a stack of sheets while they perform their working strokes, and along second paths when a working stroke is performed without contact with the sheets of a stack. This means that, in a conventional apparatus wherein the cutting edges of the knives are permitted to penetrate into the associated blocks irrespective of whether or not the knives have just completed a trimming operation, the wear upon the blocks is incomparably more pronounced than in the improved apparatus wherein the blocks are contacted by the respective knives only and alone if the knives have just completed their trimming operations. Since the operation of the drive means for the knives 8 and 19 need not be interrupted when the absence of a signal at the output of the transducer **30*b* denotes the failure of the conveyor 2 to deliver a stack 5** at a time when such stack should be located at the trimming station TS, the wear upon the moving parts of the improved machine is much less pronounced than in conventional machines because the number of repeated stoppages and starts is a small fraction of those in a machine wherein the absence of a stack invariably entails a stoppage of the moving parts or, at the very least, a stoppage of the drive means for the knife or knives.

The shortening and lengthening of motion transmitting members 9 and 20 in the above described manner entails a minimum of wear upon the parts of the control means so that the improved apparatus can stand long periods of uninterrupted use.

Figure 4:
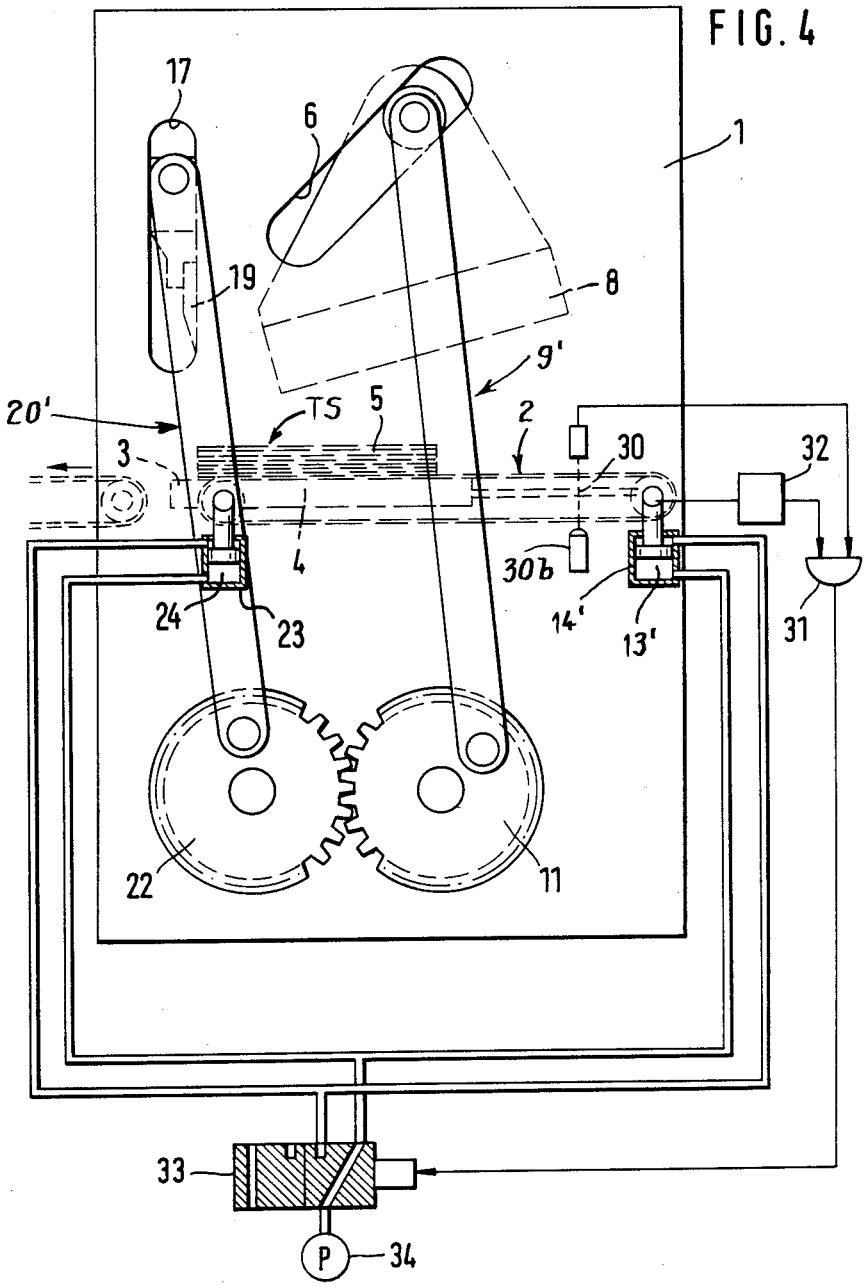
FIG. 4 is a schematic partly elevational and partly central vertical sectional view of a second trimming apparatus wherein the blocks are shiftable with reference to the path of movement of the associated knives.

FIG. 4 illustrates a portion of a second apparatus wherein all such parts which are identical with or clearly analogous to corresponding parts of the apparatus of FIG. 1 are denoted by similar reference characters. The length of the motion transmitting members 9' and 20' is constant. However, the positions of the anvil blocks 3 and 4 with reference to the associated trimming knives 19 and 8, 8 are changed in response to signals which the output of the AND gate 31 transmits to the solenoid of the valve 33. The cylinders 14', 23' and the associated pistons 13', 24' are designed to lower the conveyor 2 and the blocks 3, 4 at the trimming station TS whenever the transducer **30*b* fails to transmit a signal simultaneously with the transmission of a signal from the output of the timer 32. When the blocks 3 and 4 descend, the cutting edges of the respective knives 19 and 8, 8** reach the lower ends of their strokes prior to penetration into the material of the respective blocks.

In all other respects, the operation of the apparatus which is shown in FIG. 4 is or can be analogous to that of the first apparatus. A single cylinder and piston unit (e.g., the left-hand unit 23', 24' of FIG. 4) may suffice if the extent of axial displacement of the piston 24' is sufficient to ensure that the cutting edges of the knives 19 and 8, 8 cannot reach the respective anvil blocks when the piston 24' assumes its lower end position, i.e., when the solenoid of the valve 33 is not energized at the time when the timer 32 transmits a signal to the corresponding input of the AND gate 31, namely, when the absence of a signal at the output of the transducer **30*b* denotes the absence of a stack 5** at the trimming station TS at a time when the station TS should or is expected to accommodate a stack.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for trimming the edges of stacks of paper sheets or analogous commodities delivered to at least one trimming station, comprising conveyor means for delivering successive commodities to the trimming station; at least one knife arranged to perform recurrent working strokes during each of which the knife moves from a first to a spaced-apart second position to thereby trim an edge of a commodity at said station; drive means for moving the knife between said positions in substantial synchronism with the anticipated arrival of commodities at said station, said drive means including a linkage connecting said knife with a motor; an anvil block located in the path of movement of and being normally engaged by the knife when the latter completes a working stroke; and control means actuatable to prevent engagement between the knife and the block without interrupting operation of said drive means when the knife completes a working stroke in the absence of a commodity at said station, said control means including means for shifting the knife, and said shifting means being disposed in said linkage.

2. The apparatus of claim 1, wherein said knife is respectively located at a higher and a lower level in the first and second positions thereof.

3. The apparatus of claim 1, further comprising means for monitoring said trimming station and for generating signals which actuate said control means in response to detected absence of a commodity at said station while the knife performs a working stroke.

4. The apparatus of claim 3, wherein said control means comprises at least one fluid-operated motor arranged to maintain said knife and said block out of contact with one another in response to a signal from said monitoring means.

5. The apparatus of claim 3, further comprising at least one additional knife for trimming another edge of the commodity at said trimming station, an additional anvil block for said additional knife, and additional drive means for said additional knife, said control means being arranged to prevent said additional knife from engaging said additional block in response to a signal from said monitoring means.

6. The apparatus of claim 3, wherein said knife has a cutting edge which penetrates into said block on completion of a working stroke in the absence of a signal from said monitoring means.

7. The apparatus of claim 3, wherein said drive means comprises a variable-length motion transmitting device operatively connected with said knife and said control means includes means for changing the length of said motion transmitting device in response to a signal from said monitoring means.

8. The apparatus of claim 3, wherein said monitoring means comprises a photoelectronic transducer.

9. The apparatus of claim 5, wherein said control means is arranged to prevent engagement between said additional knife and said additional block without interrupting operation of said additional drive means.

10. Apparatus for trimming the edges of stacks of paper sheets or analogous commodities delivered to at least one trimming station, comprising conveyor means for delivering successive commodities to the trimming station; at least one knife arranged to perform recurrent working strokes during each of which the knife moves from a first to a spaced apart second position to thereby trim an edge of a commodity at said station; drive means for moving the knife between said positions in substantial synchronism with the anticipated arrival of commodities at said station; an anvil block located in the path of movement of and being normally engaged by the knife when the latter completes a working stroke, said anvil block being mounted on said conveyor means; and control means actuatable to prevent engagement between the knife and the block without interrupting operation of said drive means when the knife completes a working stroke in the absence of a commodity at said station, said control means including means for shifting said conveyor means and thereby the anvil block.

* * * * *